US005789486A

United States Patent [19]

Maruoka et al.

[11] Patent Number: 5,789,486

[45] Date of Patent: Aug. 4, 1998

[54] COATED GOLF BALL

[75] Inventors: Kiyoto Maruoka; Kuniyasu Horiuchi, both of Kobe, Japan

[73] Assignee: Sumitomo Rubber Industries, Ltd., Hyogo-ken, Japan

[21] Appl. No.: 497,745

[22] Filed: Jul. 3, 1995

[30] Foreign Application Priority Data

Jul. 4, 1994 [JP] Japan ..... 6-151997

[51] Int. Cl.[6] ..... A63B 37/12; C09D 7/12; C09D 175/04; C09D 133/06

[52] U.S. Cl. ..... 525/123; 473/371; 473/373; 473/374; 473/378; 525/127

[58] Field of Search ..... 273/235 A, DIG. 8, 273/DIG. 16; 525/123, 127; 473/371, 373, 374, 378

[56] References Cited

U.S. PATENT DOCUMENTS

| | | | |
|---|---|---|---|
| 4,679,794 | 7/1987 | Yamada et al. | 273/235 R |
| 4,688,801 | 8/1987 | Reiter . | |
| 4,802,674 | 2/1989 | Kitaoh | 273/235 A |
| 4,972,000 | 11/1990 | Kawashima | 521/54 |
| 5,268,347 | 12/1993 | Okumura et al. | 503/227 |
| 5,502,100 | 3/1996 | Maruoka et al. | 524/430 |

FOREIGN PATENT DOCUMENTS

| | | |
|---|---|---|
| 0601861 | 6/1994 | European Pat. Off. . |
| 2285401 | 7/1995 | United Kingdom . |

*Primary Examiner*—David Buttner

[57] ABSTRACT

The present invention provides a coated golf ball which suppresses sagging of the paint at the dimple edge after coating, maintains original flying characteristics which the dimple shape possesses, and provides excellent coating appearance. The coated golf ball of the present invention comprises a golf ball body and a paint layer formed thereon, wherein said paint layer is formed from a paint which comprises internally-crosslinked polymer gel fine particles dispersed therein.

4 Claims, 1 Drawing Sheet

COATED GOLF BALL

DEFINITION OF THE TERMS

The term "golf ball body" means a golf ball before coating with a paint.

The term "coated golf ball" means a golf ball after coating with a paint.

FIELD OF THE INVENTION

Figure 1:
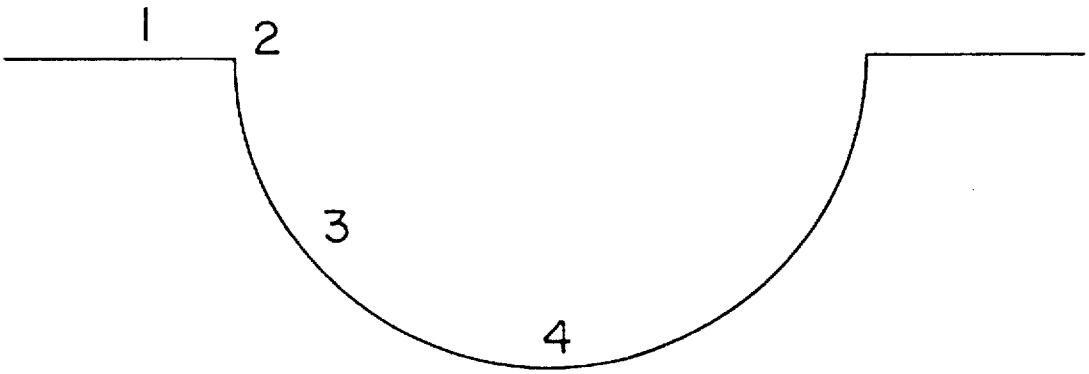
FIG. 1 is a schematic view in cross section of a dimple on a golf ball surface.

The present invention relates to a coated golf ball which comprises a golf ball body and a paint layer formed thereon. More particularly, it relates to a coated golf ball which is designed to prevent degradation of its flying characteristics.

BACKGROUND OF THE INVENTION

Golf balls are generally coated with a paint in order to look beautiful or to prevent damage to the surface. The paint layer is generally formed from either an enamel paint containing pigments such as titanium oxide, etc., and a clear paint containing no pigments formed on the enamel paint layer, or a clear paint only.

The golf ball also has many concaves, called dimples, all over the surface to improve flying characteristics. With the conventional coating technique, the coated golf ball provides shorter flying distance than a golf ball before coating. This may be attributed to coating paint for golf balls, which deforms the dimple shape.

Referring to FIG. 1, the reason why the dimple shape is deformed is described. With the conventional paint, it Is assumed that the paint layer at the edge shown by 2 is very thin in comparison with a land 1, slope 3 and bottom 4 in FIG. 1. This is because low viscosity of the paint used for coating the golf ball causes the paint on the edge 1 to sag and collect at the dimple bottom, thereby deforming the dimple shape.

To suppress the sagging of the paint film, fine silica particles are formulated in the paint, but they show poor dispersibility in the paint and the paint film obtained therefrom show poor gloss and poor transparency.

OBJECTS OF THE INVENTION

Under these circumstances, it is an object of the present invention to provide a coated golf ball which suppresses sagging of the paint at the dimple edge (2 in FIG. 1) after coating, maintains original flying characteristics which the dimple shape possesses, and provides excellent coating appearance.

SUMMARY OF THE INVENTION

That is, the present invention relates to a coated golf ball which comprises a golf ball body and a paint layer formed thereon, wherein the paint layer is formed from a paint which comprises internally-crosslinked polymer gel fine particles dispersed therein.

DETAILED DESCRIPTION OF THE INVENTION

The paint for the golf ball used for the present invention comprises internally-crosslinked polymer gel fine particles.

The polymer gel fine particles can be obtained by polymerizing monomers using art-known methods; i.e. emulsion polymerization, dispersion polymerization, suspension polymerization, and the like. The polymer gel fine particles of the present invention must be internally-crosslinked, and internal-crosslinking is enabled by employing polyfunctional monomers partly included in a monomer formulation used for polymerization. Specific examples of monofunctional monomers which form polymer gel fine particles include acrylic monomers, such as methyl (meth)acrylate and ethyl (meth)acrylate; styrenes, such as styrene, α-methyl styrene, and the like. Examples of polyfunctional monomers include monomers having at least two polymerizable unsaturated double bonds excepting diene monomer, such as ethyleneglycol di(meth)arylate, neopentylglycol di(meth)acrylate, trimethylolpropane ti(meth)acrylate, propyleneglycol di(meth)arylate, 1,6-hexanediol di(meth) acrylate, divinyl benzene, trivinyl benzene and the like. The reason why the diene monomer is excluded is that the diene monomer is generally acted in polymerization reaction as monofunctional monomer although it has two double bonds, —CH=CH—CH=CH—.

For the internally-crosslinked polymer gel fine particles used for the present invention, acryl-styrene copolymer resin is more preferable. Each of the gel fine particles preferably has at least a void therein because of excellent dispersibility. Because of the presence of voids, polymer gel fine particles provide comparatively small specific gravity, which is preferably in the range of 0.9 to 1.2.

The internally-crosslinked polymer gel fine particles preferably have a particle size of 25 μm or less, more preferably 5 μm or less, which provides particularly good coating performance. A lower limit of the particle size of the gel fine particles is 0.01 μm. It is very difficult to obtain the particle size of less than 0.01 μm. When the gel fine particles are used for clear paint, they preferably have a particle size of not more than 1 μm, more preferably not more than 0.3 μm, from the viewpoint of appearance having good gloss retention. An example of polymer gel fine particles includes powder type plastic pigment commercially available from Dainippon Ink & Chemicals Co., Ltd. as GRANDOLL PP-2000S.

The polymer fine particles are preferably contained in an amount of 0.1 to 5% by weight based on a dry weight of the paint, for providing excellent sagging prevention effects. For clear paint, 0.5–2% by weight of the polymer gel fine particles based on a dry weight of the paint particularly provides excellent appearance and good sagging prevention effects.

For the paint used for the present invention, epoxy-based paint, acryl-based paint and urethane-based paint can be exemplified, but the urethane-based paint is most preferable. The urethane-base paint preferably comprises an active hydrogen-containing polymer, such as polyester-polyol and polyether-polyol as a major component and an isocyanate compound as a curing agent. The isocyanate compound preferably includes 1,6-hexamethylene diisocyanate modified material (biuret, trimethylolpropane modified one, trimerized one, etc.), tolylene diisocyanate modified material and the like.

If the paint is an enamel paint, a coloring agent, particularly white pigment (for example, titanium oxide) is contained. The amount is suitably 45–60% by weight, preferably 50 to 55% by weight, based on a solid content of the paint. When the amount is smaller than 40% by weight, opacifying power of coating becomes inferior. When it exceeds 60% by weight, physical properties of the coating become inferior. In the case of a clear paint, a coloring agent is basically not contained.

In the paint, various additives, curing catalysts, and diluents may be contained in addition to the above components. Examples of additives include ultraviolet inhibitors, flowing agents, sealing pigments, and fluorescent agent or fluorescent brighteners. An amount of these additives is 0.1–10% by weight based on the solid content of the coating.

The fluorescent agent or fluorescent brightener formulated in the paint may be those generally known and used in golf balls. Representative examples of the fluorescent agents and brighteners are 2,5-bis-[5'-t-butylbenzoxazolyl(2)] thiophene (commercially available from Japan Ciba Geigy Co., Ltd. as Yubitex OB), 7-(2h-naphthol-(1,2-d)-triazol-2-Y1)-3-phenylcusline (commercially available from Sandz Co. as Leucopure EGM), biazoline derivative (commercially available from Morbey Chemical Corporation as Phorwhite K-2002), oxazoles (commercially available from Sumitomo Chemical Industries Co. as Whitefluar HCS, PCS, and B), and a fluorescent brightener (available from Hoechst Japan Co., Ltd, as Hostalux KCB). The fluorescent agent and brightener may be contained in an amount of 0.005–1.0% by weight based on a solid content of the coating.

The diluents used for the paint include ketones such as acetone, methyl ethyl ketone, and the like; aromatic hydrocarbons such as toluene, xylene, and the like; esters such as ethyl acetate, and the like. An amount of the diluent is not specifically limited but is 30–80% by weight.

The paint may be coated at a thickness of 5–70 μm per one coating. If it is thinner than 5 μm, no significant difference is found in suppression of paint sagging whether the fine particles of the present invention are used or not, while if it is thicker than 70 μm, sagging of the paint increases, nearly eliminating the effects achieved by the fine particles. The golf ball body may be a one-piece ball obtained by vulcanizing and molding a rubber composition comprising cis-1,4-polybutadiene rubber. It also may be a two-piece ball which is fabricated by vulcanizing a rubber composition comprising cis-1,4-polybutadiene rubber to form a solid core, which is then covered with an ionomer cover. In addition, the golf ball body may be a thread-wound ball comprising a thread wound core to which a cover layer mainly composed of transpolyisoprene is provided.

For coating methods, examples include air gun coating or electrostatic coating, and the like, but they are not limited to them.

To explain the golf ball coating process, in general, after coating the enamel paint, the golf ball is transfer-marked using a transfer foil, etc. comprising the resin chosen from a group consisting of polyamide resin, acrylic resin, and urethane resin, as well as nitrocellulose as major resin, and then, is coated with a clear paint for finish. These processes are publicly known with respect to the golf ball manufacturing. It is also possible to use a method in which the enamel paint is not coated but the clear paint only is applied. In this invention, it is preferable to use enamel paint and clear paint, both of which provide features of this invention.

According to the present invention, sagging of the paint after coating can be suppressed, offering a coated golf ball having original flying characteristics of dimple shapes maintained.

EXAMPLES

The present invention will be described further in detail with reference to the following examples; however, these examples are not construed to limit the scope of the invention.

Examples 1 to 7, Comparative Examples 1 to 4 and Reference Examples 1 to 2

Using the following paints, two-piece golf balls comprising a solid core and an ionomer resin cover covering the solid core were coated. The coating method, coating weight, and coating process are shown as follows:

(Paints)

I: Clear paint

Two-package clear paint (main component: polyester polyol; curing agent (hexamethylene diisocyanate (HDI)); solid content about 30%; viscosity: about 15 cps).

II: White enamel paint

Urethane-based two-package white enamel paint containing titanium oxide (white pigment) (main component: polyester polyol; curing agent (hexamethylene diisocyanate (HDI)); solid content about 50%; viscosity: about 200 cps).

To both of the above paints, internally-crosslinked polymer gel fine particles or inorganic silica powders chosen from A to F below were formulated. Table 1 shows selection and amount.

(Additives)

A: Triturated acryl-styrene copolymer resin Particle size: 30 μm

B: Triturated acryl-styrene copolymer resin Particle size: 20 μm

C: Triturated acryl-styrene copolymer resin Particle size: 4 μm

D: Triturated acryl-styrene copolymer resin Particle size: 1 μm

E: Triturated acryl-styrene copolymer resin Particle size: 0.1 μm

F: Silica powders Particle size: 2 μm (A, B, and C are commercially available as MG-100-S, and D and E as PP-207S, all from Dainippon Ink and Chemicals Co., Ltd.)

(Coating Method)

Using a bell type electrostatic coating machine, the paint was uniformly applied to golf balls.

(Coating Weight)

The paint was applied so that the weight of the paint adhering to golf balls becomes 80 mg/cm$^2$ (Paint I) and 180 mg/cm$^2$ (Paint II) in dry weight, respectively.

(Coating Process)

In Examples 1–6, Comparative Example 1 and Reference Examples 1 and 2, golf ball bodies were coated with white enamel paint then stamped with a polyamide resin transfer foil, followed by coating with clear paint. In Example 7 and Comparative Example 4, golf ball bodies were coated with enamel paint and then coated with clear paint. In Comparative Example 4, golf ball bodies were coated with clear paint before coating with enamel paint.

TABLE 1

(Experimental results)

| No. | Additives Type | Additives Concentration (wt %) | Appearance Luster | Appearance Dimple shape | Appearance Paint layer | Flying characteristics Total carry | Flying characteristics Trajectory elevation angle | Paint adhesion | Paint |
|---|---|---|---|---|---|---|---|---|---|
| | | | | Examples | | | | | |
| 1 | B | 1 | ○ | ○ | ○ | 249.2 | 13.5 | ○ | I |
| 2 | C | 1 | ○ | ○ | ○ | 249.7 | 13.3 | ○ | I |
| 3 | D | 1 | ○ | ○ | ○ | 250.6 | 13.3 | ○ | I |
| 4 | E | 0.4 | ○ | ○ | ○ | 250.1 | 13.4 | ○ | I |
| 5 | E | 1 | ○ | ○ | ○ | 251.4 | 13.2 | ○ | I |
| 6 | E | 4 | ○ | ○ | ○ | 250.9 | 13.2 | ○ | I |
| 7 | E | 1 | ○ | ○ | ○ | 250.9 | 13.3 | ○ | II |
| | | | | Comparative Examples | | | | | |
| 1 | F | 1 | x | Δ | Δ | 244.3 | 13.9 | Δ | I |
| 2 | — | — | ○ | x | x | 240.5 | 14.3 | ○ | I |
| 3 | — | — | — | — | — | 251.0 | 13.1 | — | I |
| 4 | — | — | ○ | Δ | Δ | 244.1 | 13.8 | — | II |
| | | | | Reference Examples | | | | | |
| 1 | A | 1 | Δ | Δ | Δ | 243.8 | 13.8 | Δ | I |
| 2 | E | 6 | x | ○ | ○ | 249.6 | 13.2 | Δ | I |

(Evaluation Method)

1. Visually checked appearance

Gloss

○: Good

Δ: Glossy but the surface slightly feels rough.

X: No gloss

Dimple shape ○: Good

Δ: Dimple edge is slightly dim.

X: The whole dimple is dim.

2. Paint layer thickness: Dimples at three locations were extracted for each ball at random and the paint layer at sections 1–4 were evaluated as follows based on mean ratio (MIN. paint layer/MAX. paint layer).

○: 0.8 or more

Δ: 0.5 to less than 0.8

X: less than 0.5

3. Flying characteristics: By a swing machine available from True Temper Company using a driver, golf balls were hit at a club head speed of 45 m/sec and the total carry and launch angle were measured.

4. Paint adhesion: By the swing machine of True Temper Company using a driver, golf balls were hit at a club head speed of 45 m/sec after being junk in water for a week and the paint peeling condition was checked.

○: No peeling

Δ: Peeling which can be determined with a magnifier (X10) is found.

X: Peeling which can be visually determined is found.

What is claimed is:

1. A coated golf ball comprising a golf ball body and a paint layer formed thereon, wherein said paint layer is formed from a paint which includes internally-crosslinked polymer gel fine particles dispersed therein in amount of 0.1–5% by weight based on dry weight of the paint, wherein said polymer gel fine particles are formed by polymerizing a mixture containing a monofunctional monomer and a polyfunctional monomer, said monofunctional monomer being selected from the group consisting of methyl (meth) arcylate, ethyl (meth)acrylate, styrene, and α-methyl styrene, and said polyfunctional monomer being selected from the group consisting of acryl-styrene, ethyleneglycol di (meth) acrylate, neopentylglycol di (meth) acrylate, trimethylolpropane di(meth)acrylate, propyleneglycol di (meth) acrylate, 1,6-hexanediol di (meth) acrylate, divinyl benzene, and trivinyl benzene, said formed polymer gel fine particles have a particle size of 0.01–25 μm.

2. The coated golf ball according to claim 1 wherein said paint layer has a thickness of 5–70 μm.

3. The coated golf ball according to claim 1 wherein said formed polymer gel fine particles are acryl-styrene copolymer resin fine particles.

4. The coated golf ball according to claim 1 wherein at least one of said polymer gel fine particles has at least one void therein.

* * * * *